US007240994B2

(12) United States Patent
Sohn et al.

(10) Patent No.: US 7,240,994 B2
(45) Date of Patent: Jul. 10, 2007

(54) METHOD OF DRIVING AN INK-JET PRINTHEAD

(75) Inventors: Dong-kee Sohn, Seoul (KR); Keon Kuk, Yongin-si (KR); Mun-cheol Choi, Suwon-si (KR); Yong-soo Oh, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 234 days.

(21) Appl. No.: 10/882,201

(22) Filed: Jul. 2, 2004

(65) Prior Publication Data

US 2005/0001864 A1 Jan. 6, 2005

(30) Foreign Application Priority Data

Jul. 2, 2003 (KR) ..... 10-2003-0044541

(51) Int. Cl.
*B41J 2/05* (2006.01)

(52) U.S. Cl. ..... 347/57; 347/61

(58) Field of Classification Search ..... 347/9–11, 347/57, 61

See application file for complete search history.

(56) References Cited

U.S. PATENT DOCUMENTS

| | | | | |
|---|---|---|---|---|
| 4,313,124 | A | 1/1982 | Hara | |
| 4,723,129 | A | 2/1988 | Endo et al. | |
| 6,126,260 | A | 10/2000 | Lan et al. | |
| 6,582,040 | B2 * | 6/2003 | Coven et al. | 347/11 |
| 2001/0026295 | A1 | 10/2001 | Takahashi | |
| 2003/0063143 | A1 | 4/2003 | Coven et al. | |

FOREIGN PATENT DOCUMENTS

JP 58042466 A * 3/1983

* cited by examiner

*Primary Examiner*—An H. Do
(74) *Attorney, Agent, or Firm*—Lee & Morse, P.C.

(57) ABSTRACT

A method of driving an ink-jet printhead, which heats ink contained in an ink chamber using a heater to generate and expand a bubble within the ink chamber and ejects ink from the ink chamber using an expansive force of the bubble, the method including applying a main pulse to the heater to eject ink and applying a post pulse to the heater after ink has been ejected.

7 Claims, 10 Drawing Sheets

METHOD OF DRIVING AN INK-JET PRINTHEAD

BACKGROUND OF THE INVENTION

1. Field of the Invention

The present invention relates to a method of driving an ink-jet printhead. More particularly, the present invention relates to a method of driving an ink-jet printhead that is able to improve a tendency of an ink droplet ejected from the ink-jet printhead to travel straight, i.e., perpendicular to an upper surface of the ink-jet printhead, by applying a main pulse and then a post pulse to a heater. The main pulse has sufficient energy to eject an ink droplet and the post pulse has insufficient energy to eject an ink droplet but sufficient energy to generate a bubble in ink. The post pulse is applied to the heater before a meniscus, which is generated by the main pulse, on a surface of ink returns to a stable state.

2. Description of the Related Art

In general, ink-jet printheads are devices for printing a predetermined image, color or black, by ejecting a small volume droplet of printing ink at a desired position on a recording sheet. Ink-jet printheads are generally categorized into two types depending on which ink ejection mechanism is used. A first type is an electro-thermal transducer ink-jet printhead (bubble-jet type) in which a heat source is employed to form and expand a bubble in ink to cause an ink droplet to be ejected due to the expansive force of the formed bubble. A second type is a electromechanical transducer ink-jet printhead, in which an ink droplet is ejected by a pressure applied to the ink and a change in ink volume due to a deformation of a piezoelectric element.

An ink droplet ejection mechanism of a thermal ink-jet printhead will now be described in detail. When a pulse current is applied to a heater, which includes a heating resistor, the heater generates heat and ink near the heater is instantaneously heated to approximately 300° C., thereby boiling the ink. The boiling of the ink causes bubbles to be generated. Expanding bubbles exert pressure on ink filling an ink chamber. As a result, ink around a nozzle is ejected from the ink chamber in the form of a droplet through the nozzle.

Thermal driving methods include a top-shooting method, a side-shooting method, and a back-shooting method depending on the direction in which the ink droplet is ejected and the direction in which a bubbles expands. The top-shooting method is a method in which the growth direction of a bubble is the same as the ejection direction of an ink droplet. The side-shooting method is a method in which the growth direction of a bubble is perpendicular to the ejection direction of an ink droplet. The back-shooting method is a method in which the growth direction of a bubble is opposite to the ejection direction of an ink droplet.

An ink-jet printhead using the thermal driving method should satisfy the following requirements. First, manufacturing of the ink-jet printheads should be simple, costs should be low, and should facilitate mass production thereof. Second, in order to obtain a high-quality image, cross talk between adjacent nozzles should be suppressed while a distance between adjacent nozzles should be narrow; that is, in order to increase dots per inch (DPI), a plurality of nozzles should be densely positioned. Third, in order to perform a high-speed printing operation, a period in which the ink chamber is refilled with ink after ink has been ejected from the ink chamber should be as short as possible and the cooling of heated ink and heater should be performed quickly to increase a driving frequency.

FIG. 1 illustrates an exploded perspective view of a conventional ink-jet printhead using a top-shooting method. FIG. 2 illustrates a cross-sectional view of a vertical structure of the conventional ink-jet printhead of FIG. 1.

Referring to FIG. 1, the ink-jet printhead includes a base plate 10, which is formed of a plurality of material layers stacked on a substrate, a barrier wall 20, which is formed on the base plate 10 to define an ink chamber 22, and a nozzle plate 30, which is formed on the barrier wall 20. The ink chamber 22 is filled with ink. A heater (13 of FIG. 2), which heats ink and generates bubbles, is provided under the ink chamber 22. An ink passage 24 is a path along which ink is supplied into the ink chamber 22. The ink passage 24 provides flow communication from an ink reservoir (not shown). A plurality of nozzles 32, through which ink is ejected, is formed such that one of the plurality of nozzles is formed at a predetermined position to face the ink chamber 22.

The vertical structure of the ink-jet printhead described above will now be described with reference to FIG. 2. Referring to FIG. 2, an insulating layer 12 for insulating the heater 13 from a substrate 11 is formed on the substrate 11, which is formed of silicon. The heater 13, which heats ink in the ink chamber 22 and generates bubbles, is formed on the insulating layer 12. The heater 13 is formed by thinly depositing tantalum nitride (TaN) or a tantalum-aluminum alloy on the insulating layer 12 in a thin film shape. A conductor 14 for applying a current to the heater 13 is formed on the heater 13. The conductor 14 is formed of a material having high conductivity, such as aluminum or an aluminum alloy.

A passivation layer 15, which is formed on the heater 13 and the conductor 14, prevents the heater 13 and the conductor 14 from being oxidized or directly contacting ink. The passivation layer 15 is formed by depositing a silicon nitride layer on the heater 13 and the conductor 14. An anti-cavitation layer 16 is formed on a predetermined portion of the passivation layer 15, on which the ink chamber 22 is to be formed.

The barrier wall 20, which defines the ink chamber 22, is stacked on the base plate 10. The nozzle plate 30, in which the nozzles 32 are formed, is stacked on the barrier wall 20.

FIG. 3 illustrates a variation of a position of a meniscus with respect to time in response to application of a conventional driving signal to an ink-jet printhead. Referring to FIG. 3, when a driving pulse is applied to a heater, bubbles are generated in ink near the heater and continuously expand. Due to this expansion, pressure is applied to ink filling an ink chamber such that ink is ejected through a nozzle. Once ink is ejected, a position of a meniscus on the surface of the ink in the ink chamber gradually stabilizes, but still slightly fluctuates. Before the meniscus is completely damped down, the driving pulse for ejecting ink is applied again to the heater. However, if the meniscus is yet to subside sufficiently, the ejection of ink may not be performed normally.

FIG. 4 is a photograph of an ink droplet ejected from an ink-jet printhead when a meniscus on the surface of ink in an ink chamber is in a stable state. FIG. 5 is a photograph of an ink droplet ejected from an ink-jet printhead when a meniscus on a surface of ink in an ink chamber is in an unstable state. Referring to FIGS. 4 and 5, the tendency of an ink droplet ejected from the ink-jet printhead to travel straight is more distinctively shown in FIG. 4 than in FIG. 5.

In short, ink droplets ejected from an ink-jet printhead are less likely to travel straight, i.e., perpendicular to the upper surface of the printhead, when the ink meniscus is in an unstable state as compared to a state in which the ink meniscus is in a stable state.

Several conventional methods for improving the performance of an ink-jet printhead by modifying a driving signal so that ink droplets can be more efficiently ejected have been proposed. These conventional methods, however, can only thermodynamically improve the performance of an ink-jet printhead by modifying a driving signal or by increasing a temperature of the ink with the use of a pre-pulse before the ink is ejected. Thus far, methods for hydromechanically improving the performance of an ink-jet printhead by modifying a driving signal have not yet been suggested.

SUMMARY OF THE INVENTION

The present invention is therefore directed to a method of driving an ink-jet printhead, which substantially overcomes one or more of the problems due to the limitations and disadvantages of the related art.

It is a feature of an embodiment of the present invention to provide a method of driving an ink-jet printhead that is capable of stabilizing a meniscus on the surface of ink as soon as possible by applying a post pulse insufficient to eject an ink droplet but sufficient to generate a bubble in the ink.

It is another feature of an embodiment of the present invention to provide a method of driving an ink-jet printhead that is capable of improving the tendency of ink droplets ejected from the ink-jet printhead to travel straight.

It is yet another feature of an embodiment of the present invention to provide a method of driving an ink-jet printhead that hydromechanically improves the performance of the ink-jet printhead by modifying a driving signal.

At least one of the above features and other advantages may be provided by a method of driving an ink-jet printhead, which heats ink contained in an ink chamber using a heater to generate and expand a bubble within the ink chamber and ejects ink from the ink chamber using an expansive force of the bubble, the method including applying a main pulse to the heater to eject ink and applying a post pulse to the heater after ink has been ejected.

The main pulse may generate a first bubble in the ink chamber, an expansion and collapse of the first bubble causing ink to be ejected in a form of an ink droplet. The post pulse may generate a second bubble in the ink chamber, the expansion and collapse of the second bubble fails to cause ink to be ejected from the ink chamber.

The post pulse may be applied to the heater before a meniscus on a surface of ink in the ink chamber returns to a stable state after ink has been ejected.

The post pulse may be applied to the heater while the ink chamber is being refilled with ink after ink has been ejected.

The main pulse for ejecting ink may be applied to the heater for about 1–2 μs. A duration of the post pulse may be about 40–60% of a duration of the main pulse. An energy of the post pulse may be less than an energy of the main pulse.

At least one of the above features and other advantages may be provided by a method of driving an ink-jet printhead, which heats ink contained in an ink chamber using a heater to generate and expand a bubble within the ink chamber and ejects ink from the ink chamber using an expansive force of the bubble, the method including applying a main pulse to the heater to eject ink and hydromechanically stabilizing ink remaining within the ink chamber after ink has been ejected.

The hydromechanically stabilizing of the ink remaining within the ink chamber may include applying a post pulse to the heater.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
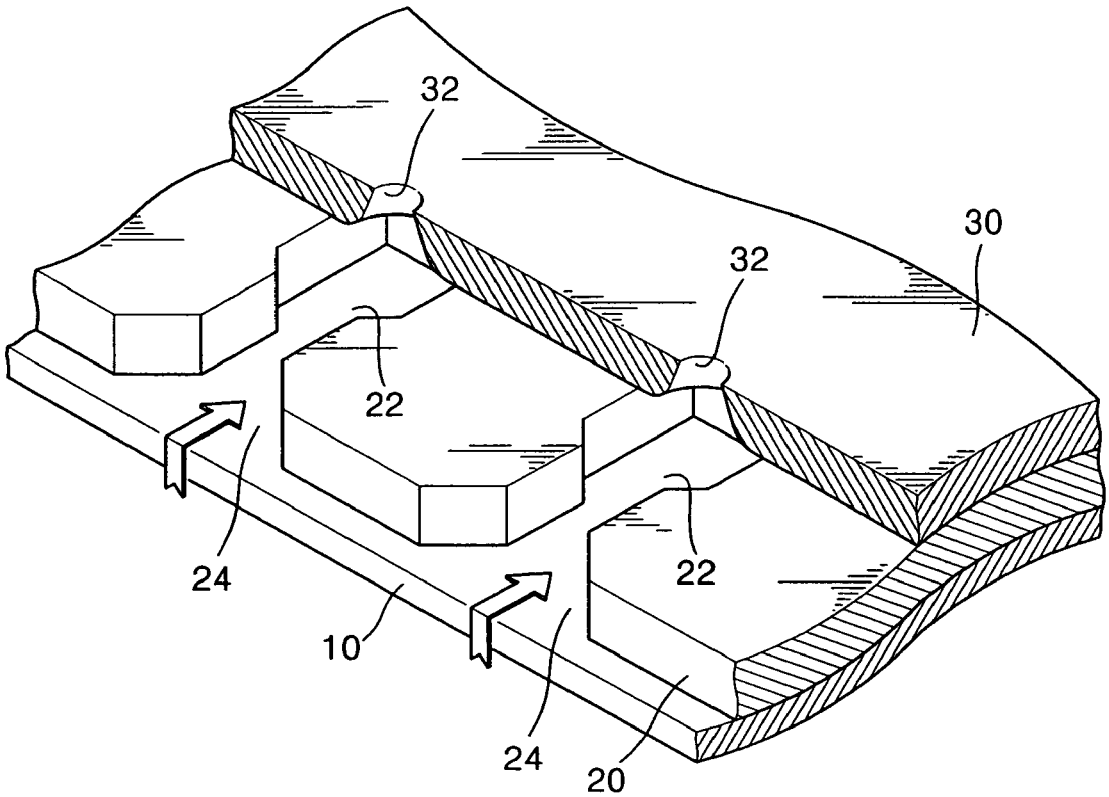
FIG. 1 (PRIOR ART)
FIG. 1 illustrates an exploded perspective view of a conventional ink-jet printhead.
Figure 2:
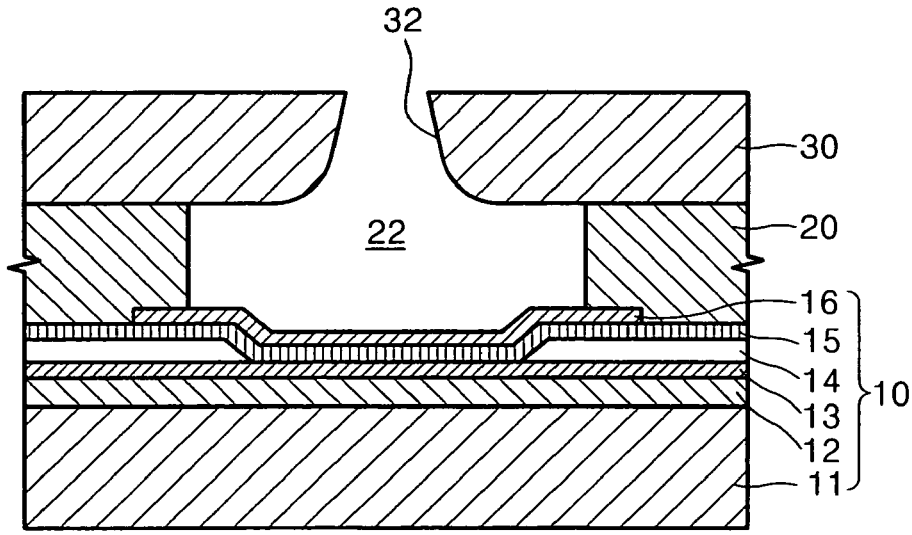
FIG. 2 (PRIOR ART)
FIG. 2 illustrates a cross-sectional view of a vertical structure of the conventional ink-jet printhead of FIG. 1.
Figure 3:
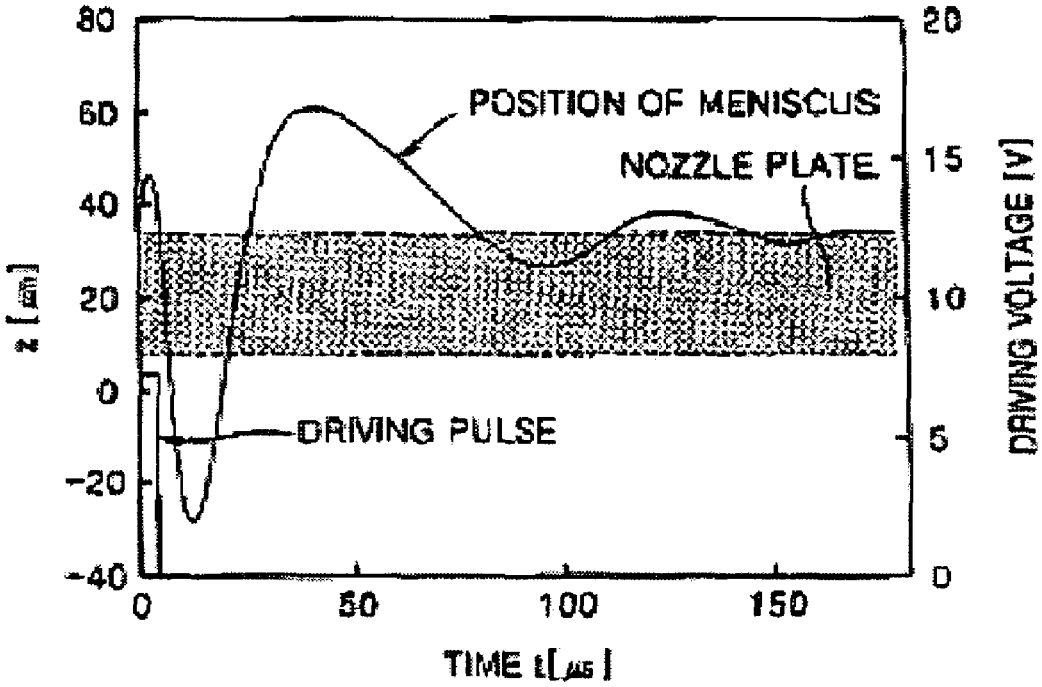
FIG. 3 (PRIOR ART)
FIG. 3 is a graph illustrating a variation of a position of a meniscus with respect to time in response to application of a conventional driving signal to an ink-jet printhead.
Figure 4:
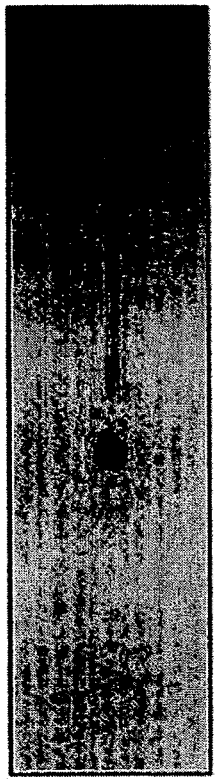
FIG. 4 (PRIOR ART)
FIG. 4 is a photograph of an ink droplet ejected from an ink-jet printhead when a meniscus on a surface of ink in an ink chamber is in a stable state.
Figure 5:
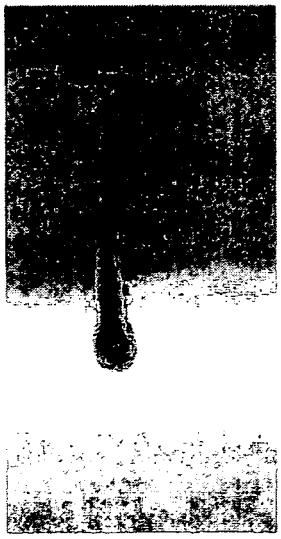
FIG. 5 (PRIOR ART)
FIG. 5 is a photograph of an ink droplet ejected from an ink-jet printhead when a meniscus on a surface of ink in an ink chamber is in an unstable state.

Korean Patent Application No. 2003-44541, filed on Jul. 2, 2003, in the Korean Intellectual Property Office, and entitled: "Method of Driving Ink-Jet Printhead," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 6:
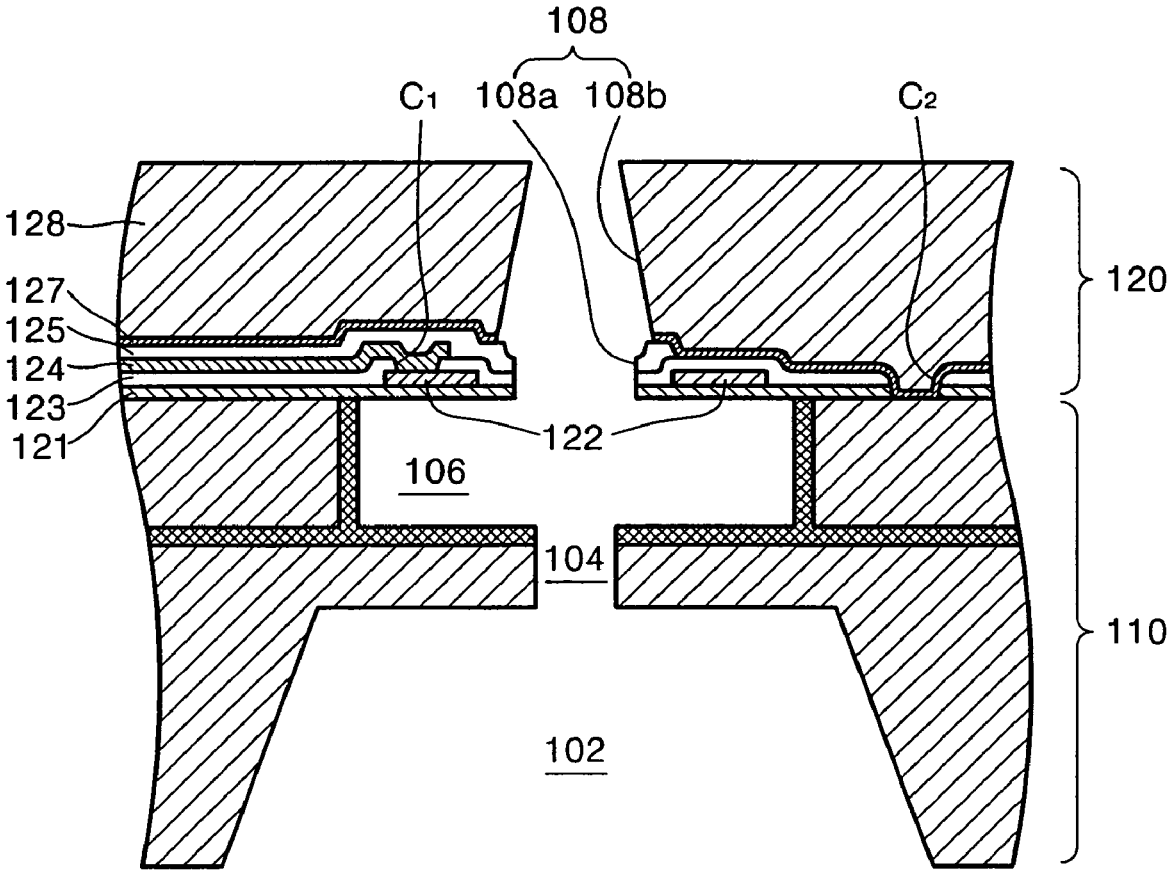
FIG. 6 illustrates a cross-sectional view of an ink-jet printhead that is driven using a method of driving an ink-jet printhead according to an embodiment of the present invention.

FIG. 6 illustrates a cross-sectional view of an ink-jet printhead that is driven using a method of driving an ink-jet printhead according to an embodiment of the present invention. Referring to FIG. 6, the ink-jet printhead includes a substrate 110 and a nozzle plate 120 stacked on the substrate 110.

An ink chamber 106 and a manifold 102 are formed in the substrate 110 so that the ink chamber 106 and the manifold 102 are located near upper and lower surfaces, respectively, of the substrate 110. The manifold 102 supplies ink to the ink chamber 106. An ink channel 104, which is formed vertically passing through the substrate 110, provides flow communication between the ink chamber 106 and the manifold 102. Accordingly, ink is supplied into the ink chamber 106 from the manifold 102 via the ink channel 104. The manifold 102 is in flow communication with an ink reservoir (not shown), which contains ink therein.

The nozzle plate 120 is stacked on the substrate 110, in which the ink chamber 106, the manifold 102, and the ink channel 104 are formed. The nozzle plate 120 constitutes an upper wall of the ink chamber 106. A nozzle 108, through which ink is to be ejected, is formed over a central portion of the ink chamber 106.

The nozzle plate 120 includes a plurality of material layers stacked on the substrate 110. The plurality of material layers may include first, second, and third passivation layers 121, 123, and 125, and a heat dissipation layer 128. A heater 122 is provided between the first and second passivation layers 121 and 123. A conductor 124, which is electrically connected to the heater 122, is provided between the second and third passivation layers 123 and 125.

The first passivation layer 121, which is a lowermost layer of the nozzle plate 120, is formed on an upper surface of the substrate 110. The first passivation layer 121 serves as an insulation layer between the substrate 110 and the heater 122 and passivates the heater 122. The first passivation layer 121 may be formed of silicon dioxide ($SiO_2$), or silicon nitride ($Si_3N_4$).

The heater 122, which heats ink in the ink chamber 106, is formed on the first passivation layer 121 over the ink chamber 106. The heater 122 may be formed of a resistive heating material, such as impurity-doped polysilicon, a tantalum-aluminum alloy, tantalum nitride, titanium nitride, or tungsten silicide.

The second passivation layer 123, which is formed on the first passivation layer 121 and the heater 122, serves as an insulation layer between the heat dissipation layer 128 and the heater 122 and passivates the heater 122. The second passivation layer, like the first passivation layer 121, may be formed of silicon nitride ($Si_3N_4$) or silicon dioxide ($SiO_2$).

The conductor 124, which is formed on the second passivation layer 123, is electrically connected to the heater 122 so that it can apply a pulse current to the heater 122. A first end of the conductor 124 is connected to the heater 122 via a first contact hole $C_1$ formed on the second passivation layer 123. A second end of the conductor 124 is electrically connected to a bonding pad (not shown). The conductor 124 may be formed of a material having high conductivity, such as aluminum (Al), an aluminum alloy, gold (Au), or silver (Ag).

The third passivation layer 125 may be formed on the conductor 124 and the second passivation layer 123. The third passivation layer 124 may be formed of tetraethylorthosilicate (TEOS) oxide, silicon dioxide ($SiO_2$), or silicon nitride ($Si_3N_4$).

The heat dissipation layer 128 is formed on the third passivation layer 125 and the second passivation layer 123 to thermally contact the upper surface of the substrate 110 via a second contact hole $C_2$. The second contact hole $C_2$ is formed through the second passivation layer 123 and the first passivation layer 121. The heat dissipation layer 128 may be formed of at least one metal layer, and the at least one metal layer may be formed of a metallic material having high conductivity, such as nickel (Ni), copper (Cu), aluminum (Al), or gold (Au). The heat dissipation layer 128 may be formed by electroplating the metallic material on the second and third passivation layers 123 and 125 to a relatively thick thickness of about 10–100 μm. A seed layer 127 may be formed in order to electroplate the metallic material on the second and third passivation layers 123 and 125. The seed layer 127 may be formed of at least one metal layer, and the at least one metal layer may be formed of a metallic material having high conductivity, such as copper (Cu), chromium (Cr), titanium (Ti), gold (Au), or nickel (Ni). 127 may be formed of at least one metal layer, and the at least one metal layer may be formed of a metallic material having high conductivity, such as copper (Cu), chromium (Cr), titanium (Ti), gold (Au), or nickel (Ni).

As described above, since the heat dissipation layer 128 is formed through electroplating, it may be formed in a single body together with other elements of the ink-jet printhead. In addition, since the heat dissipation layer 128 is formed relatively thickly on the second and third passivation layers 123 and 125, it is able to efficiently dissipate heat.

Since the heat dissipation layer 128 thermally contacts the upper surface of the substrate 110 via the second contact hole $C_2$, it transmits heat generated by the heater 122 to the substrate 110. In particular, after an ink droplet is ejected, heat generated by the heater 122 is dissipated to the substrate 110 and then out of the printhead. Therefore, heat generated by the heater 122 can be more quickly dissipated. Resultantly, the nozzle 108 and a vicinity thereof are quickly cooled. Accordingly, it is possible to more stably print images at high operating frequencies.

As described above, since the heat dissipation layer 128 can be formed relatively thickly, it is possible to form a nozzle 108 having a length sufficient to enable high-speed printing and improve the tendency of ink droplets ejected through the nozzle 108 to travel straight. More specifically, ink droplets can be ejected through the nozzle 108 in a direction substantially perpendicular to the surface of the substrate 110.

The nozzle 108, which is formed through the nozzle plate 120, includes a lower nozzle **108*a* and an upper nozzle 108*b*. The lower nozzle 108*a* is formed in a pillar shape and passes through the first, second, and third passivation layers 121, 123, and 125 of the nozzle plate 120. The upper nozzle 108*b* is formed through the heat dissipation layer 128. The upper nozzle 108*b* may be formed in a pillar shape. Alternatively, the upper nozzle 108*b* may be formed in a tapered shape having a cross-sectional area that decreases toward an opening of the nozzle 108, as shown. In the case of a tapered upper nozzle 108*b*, a meniscus on the surface of ink in the ink chamber 106** can be stabilized more quickly after ink is ejected.

A detailed description of a method of driving an ink-jet printhead according to the embodiment of the present invention will now be provided.

Figure 7:
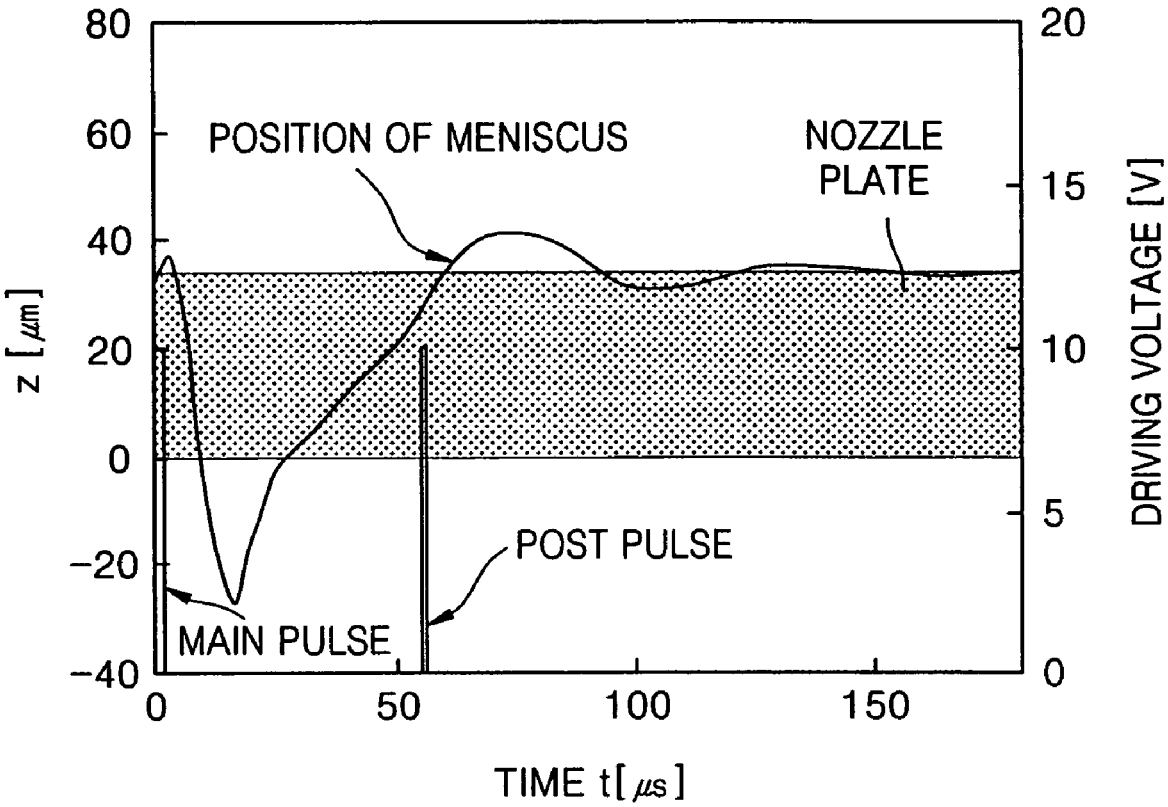
FIG. 7 is a graph illustrating a main pulse and a post pulse applied to an ink-jet printhead that is driven using the method of driving an ink-jet printhead according to the embodiment of the present invention.

FIG. 7 is a graph illustrating a main pulse and a post pulse applied to an ink-jet printhead that is driven using the method of driving an ink-jet printhead according to the embodiment of the present invention. In particular, FIG. 7 illustrates a variation of a position of meniscus with respect to time in response to application of a main pulse and a subsequent post pulse to a heater of an ink-jet printhead.

Referring to FIG. 7, a main pulse for ejecting ink is applied to a heater (122 of FIG. 6) of an ink-jet printhead for about 1–2 μs. After ink is ejected, a meniscus on a surface of ink descends toward the ink chamber. Then, if the ink chamber is refilled with ink, the meniscus rises. At this point, a post pulse having energy sufficient to generate a bubble in the ink contained in the ink chamber but insufficient to eject ink is applied to the heater (122). The duration of the post pulse may be about 40–60% of that of the main pulse. A magnitude of the post pulse may be about that of the main pulse. Any variation of the magnitude and/or duration of the post pulse that achieves post pulse characteristics as described above may be used.

As described above, if the post pulse is applied to the heater when the meniscus begins to rise after the ejection of ink, a bubble generated by the post pulse continuously expands, thereby promoting the refilling of ink. The bubble bursts before the meniscus rises above the upper surface of a nozzle plate (120 of FIG. 6), which results in a negative pressure in the ink chamber. Due to the negative pressure in the ink chamber, the height of the meniscus rising from the upper surface of the nozzle plate decreases as compared to the conventional ink-jet printhead and the meniscus can be more quickly stabilized. In other words, application of the post pulse hydromechanically stabilizes the ink remaining in the ink chamber.

The duration of fluctuation of the position of the meniscus may vary depending on the design of the ink chamber of the ink-jet printhead. Accordingly, the duration or interval of the post pulse applied to the heater should be optimized depending on the design of the ink chamber.

An ink ejection mechanism of an ink-jet printhead that is driven by the method of driving an ink-jet printhead according to the embodiment of the present invention, will be described in greater detail with reference to FIGS. 8A through 8D.

Figure 8A:
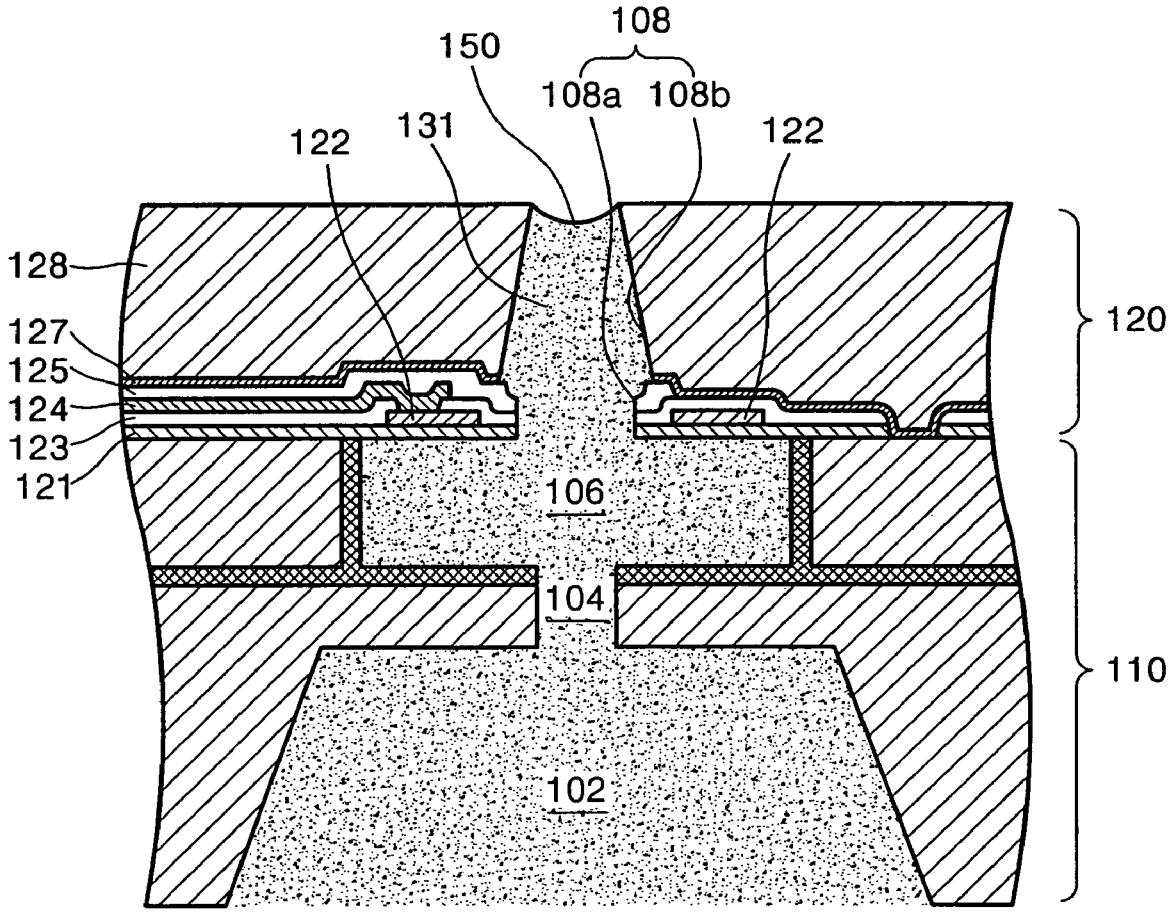
FIGS. 8A through 8D illustrate stages in a process of ejecting an ink droplet from an ink-jet printhead that is driven using the method of driving an ink-jet printhead according to the embodiment of the present invention.
Figure 8B:
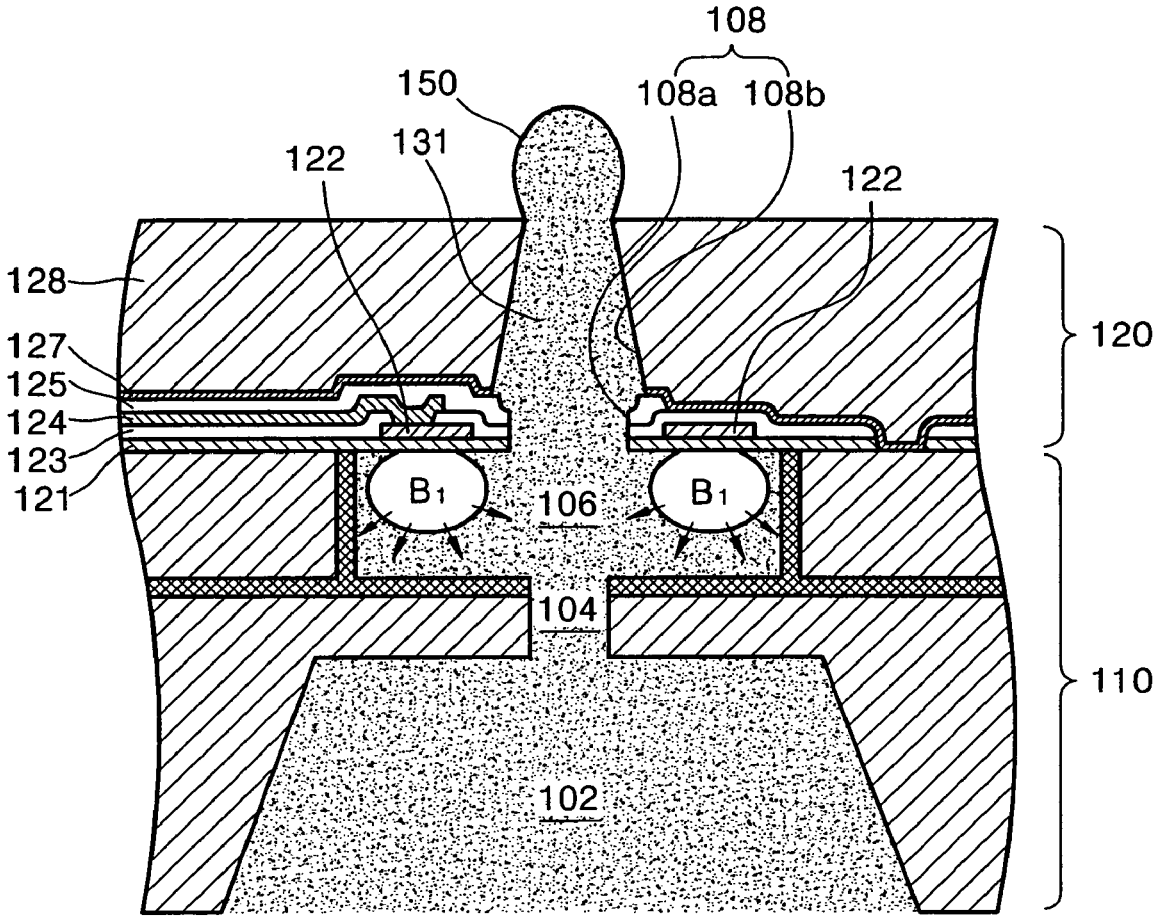

Referring to FIG. 8A, the ink chamber 106 and the nozzle 108 are filled with ink 131. At this time, a meniscus 150 on a surface of the ink 131 is within the nozzle plate 120. When a main pulse is applied to the heater 122 via the conductor 124, heat is generated by the heater 122. The heat is transmitted to the ink 131 in the ink chamber 106 via the first passivation layer 121 under the heater 122. Accordingly, the ink 131 boils, thereby forming a first bubble $B_1$, as shown in FIG. 8B. The first bubble $B_1$ continuously expands due to the heat supplied from the heater 22 such that the meniscus 150 on the surface of the ink 131 protrudes from a nozzle 108.

Figure 8C:
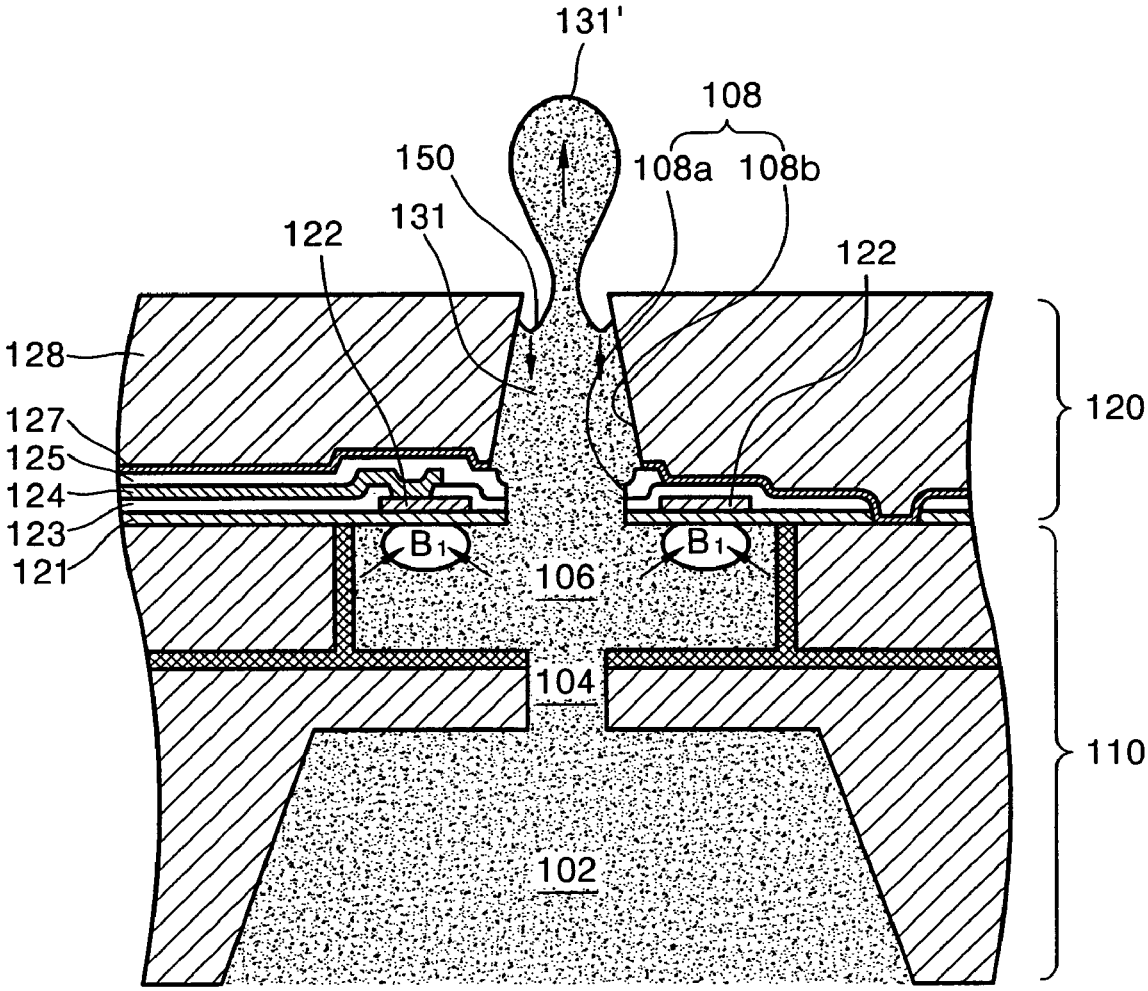

Referring to FIG. 8C, when the first bubble $B_1$ expands to a maximum size, the main pulse is cut off. As a result, the first bubble $B_1$ continuously contracts to dissipate. Hence, a negative pressure is applied to an interior of the ink chamber 106, so that the ink 131 in the nozzle 108 returns to the ink chamber 106. The ink 131 protruding from the nozzle 108 is separated from the ink in the nozzle 108 due to inertia and is ejected in a droplet form through the nozzle 108. Once the ink droplet 131' is ejected through the nozzle 108, the meniscus 150 retreats away from the nozzle 108 toward the ink chamber 106.

Figure 8D:
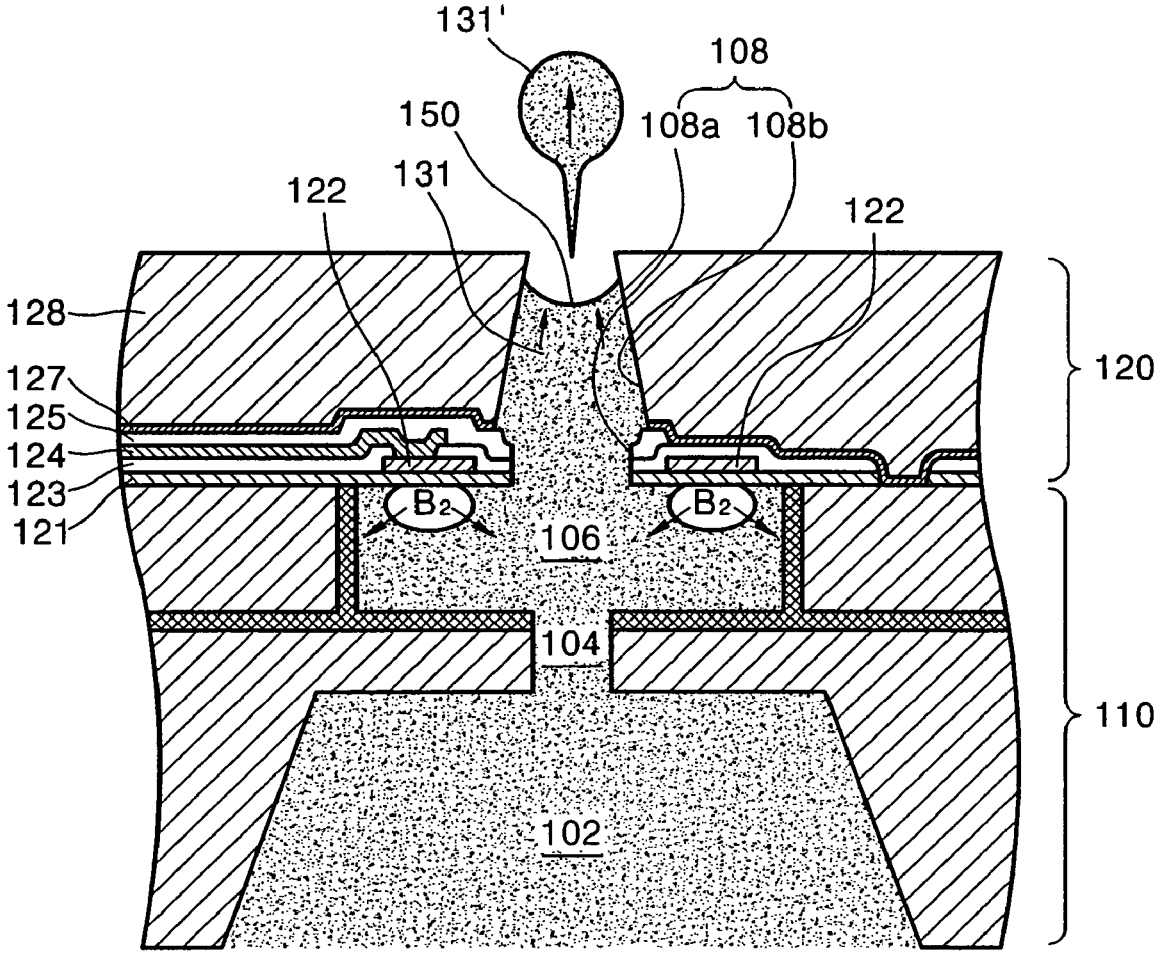

Referring to FIG. 8D, when the negative pressure in the ink chamber 106 dissipates, the meniscus 150 rises again toward an opening of the nozzle 108 due to the surface tension of the ink 131. Accordingly, the ink chamber 106 is refilled with the ink 131 supplied from the manifold 102 via the ink channel 104.

During refilling the ink chamber 106 with the ink 131, a post pulse having energy sufficient to generate a bubble but insufficient to eject an ink droplet from the nozzle 108 is applied to the heater 122. As a result, a second bubble $B_2$ is generated in the ink chamber 106. The second bubble $B_2$ continuously expands, thus promoting the refilling of the ink chamber 106 with the ink 131. Subsequently, the post pulse is cut off. Then, the second bubble $B_2$ dissipates, the refilling of the ink chamber 106 with the ink 131 is complete, and the ink-jet printhead returns to an original state, i.e., the condition before the main pulse was applied to the heater 122. Here, due to the bursting of the second bubble $B_2$, the meniscus 150 on the surface of the ink 131 can be quickly stabilized.

As described above, it is possible to quickly stabilize the meniscus 150 on the surface of the ink 131 after ink is ejected through the nozzle 108 by applying the post pulse to the heater 122 before the meniscus 150 returns to a stable state. Resultantly, an ink droplet 131', which is ejected through the nozzle after the meniscus is stabilized, has a greater tendency to travel straight.

Figure 9:
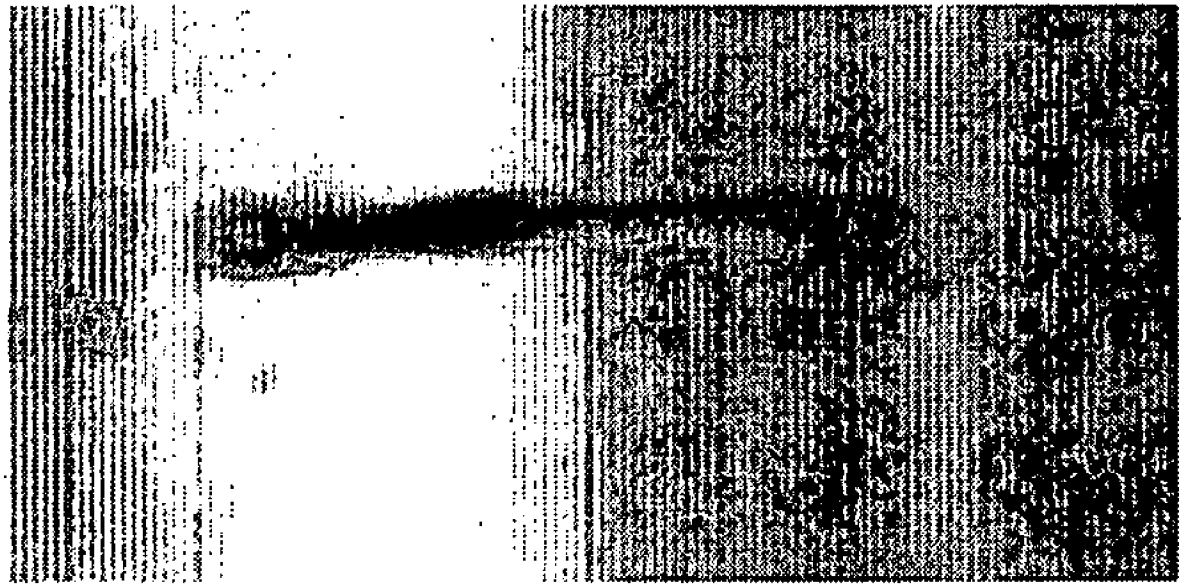
FIG. 9 is a photograph of an ink droplet ejected from an ink-jet printhead that is driven using the method of driving an ink-jet printhead according to the embodiment of the present invention.

FIG. 9 is a photograph of an ink droplet ejected from an ink-jet printhead that is driven using the method of driving an ink-jet printhead according to the embodiment of the present invention. As shown in FIG. 9, an ink droplet ejected from the ink-jet printhead that is driven using the method of driving an ink-jet printhead according to the embodiment of the present invention, has a greater tendency to travel straight, as compared to ink-jet printheads driven by conventional methods.

The method of driving an ink-jet printhead according to the embodiment of the present invention may be applied to all types of thermal ink-jet printheads, including thermal ink-jet printheads employing a back-shooting method, a top-shooting method, or a side-shooting method.

As described above, the method of driving an ink-jet printhead according to the embodiment of the present invention has the following advantages.

First, it is possible to quickly stabilize a meniscus on a surface of ink after ink is ejected by applying a post pulse to a heater before the meniscus returns to a stable state.

Second, since ink is ejected only after the meniscus on the surface of the ink has reached a stable state, a tendency of the ejected ink to travel straight may be enhanced.

Third, it is possible to prevent ink from being abnormally ejected at high frequencies.

Exemplary embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A method of driving an ink-jet printhead, which heats ink contained in an ink chamber using a heater to generate and expand a bubble within the ink chamber and ejects ink from the ink chamber using an expansive force of the bubble, the method comprising:

applying a main pulse to the heater to generate a first bubble in the ink chamber to cause ink to be ejected from the ink-jet printhead; and applying a post pulse to the heater after ink has been ejected to generate a second bubble in the ink chamber to refill the ink chamber.

2. The method as claimed in claim 1, wherein the post pulse is applied to the heater before a meniscus on a surface of ink in the ink chamber returns to a stable state after ink has been ejected.

3. The method as claimed in claim 1, wherein the main pulse for ejecting ink is applied to the heater for about 1–2 μs.

4. The method as claimed in claim 1, wherein a duration of the post pulse is about 40–60% of a duration of the main pulse.

5. The method as claimed in claim 1, wherein an energy of the post pulse is less than an energy of the main pulse.

6. A method of driving an ink-jet printhead, which heats ink contained in an ink chamber using a heater to generate and expand a bubble within the ink chamber and ejects ink from the ink chamber using an expansive force of the bubble, the method comprising:

applying a main pulse to the heater to generate a first bubble in the ink chamber to cause ink to be ejected from the ink-jet printhead; and hydromechanically stabilizing ink remaining within the ink chamber after ink has been ejected to generate a second bubble in the ink chamber to refill the ink chamber.

7. The method as claimed in claim 6, wherein hydromechanically stabilizing the ink remaining within the ink chamber comprises applying a post pulse to the heater.

* * * * *